US005199416A

United States Patent [19]

Gumienny et al.

[11] Patent Number: 5,199,416

[45] Date of Patent: Apr. 6, 1993

[54] HOT AIR HEAT EXCHANGER

[75] Inventors: Gerd Gumienny, Landsberg a. Lech; Jaroslav Klouda, Fuerstenfeldbruck; Franz Koch, Untermeitingen, all of Fed. Rep. of Germany

[73] Assignee: Rational Grosskuechentechnik Service GmbH, Fed. Rep. of Germany

[21] Appl. No.: 808,743

[22] Filed: Dec. 17, 1991

[30] Foreign Application Priority Data

Jun. 19, 1991 [DE] Fed. Rep. of Germany ..... 4120250

[51] Int. Cl.[5] ..... F24B 1/189

[52] U.S. Cl. ..... 126/522; 126/110 AA; 126/99 A

[58] Field of Search ..... 126/110 R, 500, 522, 126/534, 535, 536, 537, 538, 539, 99 A, 110 AA; 98/45

[56] References Cited

U.S. PATENT DOCUMENTS 4,010,728 3/1977 Hempel et al. ..... 126/522 X
4,325,353 4/1982 Husa ..... 126/522 X
4,469,276 9/1984 Marcum ..... 126/522
5,016,613 5/1991 Maitland ..... 126/500 X

*Primary Examiner*—Larry Jones
*Attorney, Agent, or Firm*—Hill, Steadman & Simpson

[57] ABSTRACT

A hot air heat exchanger comprises a heat exchanger housing having a floor, which is essentially formed by a ceiling of an outer chamber and has at least one heat exchanger pipe extending from the floor to a ceiling element having exhaust openings, each pipe is secured to an exhaust opening in the upper wall of the outer chamber and a burner is disposed in an inner chamber which is positioned inside of the outer chamber with a spacing between the wall of the inner chamber and the outer chamber to allow air to flow therethrough. The upper wall of the inner chamber is provided with an exhaust gas opening, which is aligned with the exhaust opening of the outer chamber, and both openings have peripheral walls that are tapered to form a Venturi-like nozzle for drawing air in the space between the inner and outer chambers into each pipe as the exhaust gas from the burner in the inner chamber flows into the pipe to pass up through an exhaust element in the ceiling of the heat exchanger housing.

13 Claims, 1 Drawing Sheet 1
2
3
4
5
6
10
12
14
16
18
32
34
36
38
40
42
44
50
52
54
56
60
62
64
66
68
100
α

HOT AIR HEAT EXCHANGER

BACKGROUND OF THE INVENTION

The present invention is directed to an improvement in a hot air heat exchanger which has a housing with a ceiling and a floor spaced from the ceiling which floor is formed by a ceiling or upper wall of an outer chamber, which contains a burner, and the heat exchanger has at least one heat exchanger pipe extending between the floor and the ceiling of the heat exchanger to carry exhuast gases from the burner.

In a hot air heat exchanger which has heat exchange pipes that extend from a floor, which is an upper wall of a chamber containing a burner for removing exhaust gases and wherein a blower may be provided, both the pipes, as well as the upper wall of the outer chamber, become extremely hot during operation. Temperatures up to 1000° C. can be reached at these surfaces. As a result thereof, excessive thermal stresses will occur, particularly in the transition region between the floor of the heat exchanger housing, i.e., the upper wall of the outer chamber, and each of the heat exchange pipes. In order to guarantee a gas-tight connection between the upper wall of the chamber and each heat exchanger pipe, these are welded to one another. Apart from the fact that a welded connection makes the replacement of the components more difficult when, for example, these are corroded or become eroded by scale, it has been shown that the region of the weld ages extremely quickly during long-term operations and is, therefore, not especially durable. Since many heat exchanger pipes which have a comparatively small cross section must be employed in order to guarantee a good heat transfer from the heat exchanger pipes into the surrounding space, the problem of thermal stressing in the transition regions is greatly increased.

SUMMARY OF THE INVENTION

It is an object of the present invention to create a hot air heat exchanger that not only has good heat transfer properties, but, above all, enables the replacement of individual components with the least amount of problems.

To achieve these objects, the present invention is directed to an improvement in a hot air heat exchanger which comprises a heat exchanger housing having a floor which is essentially formed by an upper wall of an outer chamber in which a burner is located, said heat exchanger including at least one heat exchanger pipe extending between the floor and a ceiling of the heat exchanger for receiving exhaust gases of the burner and transferring heat from these exhaust gases to air which flows around the outside of the heat exchange pipes. The improvements include the burner being disposed in an inner chamber, which is arranged in the outer chamber with an all-around spacing between the inside wall of the outer chamber and the outer wall of the inner chamber, the inner chamber having an exhaust gas opening for each of the heat exchange pipes in an upper wall portion, said exhaust gas opening being provided with a perimeter wall that tapers in a direction toward the heat exchanger pipe and the outer chamber having an outer or exhaust opening aligned with each exhaust gas opening of the inner chamber and each of the outer openings also being provided with a perimeter wall that tapers in the direction toward the heat exchanger pipe, said heat exchanger pipe being secured essentially in a gas-tight manner to the outer opening so that a space between the inside wall of the outer chamber and the outside wall of the inner chamber is in communication with ambient air which will flow into an annular gap between the perimeter walls of the exhaust gas opening and the outer opening and into the heat exchange pipe.

The hot air heat exchanger of the invention is, thus, characterized in that the burner is accommodated in an inner chamber, whose outer wall is arranged in the outer chamber with an all-around spacing from the inside surface of the walls of the outer chamber. The inner chamber comprises a plurality of exhaust gas openings in its upper wall which correspond in number to the number of heat exchanger pipes and each of the exhaust gas openings is provided with a perimeter wall tapering in a direction toward the heat exchanger pipe. The outer chamber also has a plurality of outer openings which are aligned with the exhaust gas openings and each of these outer openings is also provided with a perimeter wall which will taper in the direction toward the heat exchanger pipe, and the heat exchanger pipe is, respectively, secured essentially in a gas-tight manner to these outer openings of the outer chamber. The space between the inside wall surface of the outer chamber and the outside wall surface of the inner chamber is in communication with ambient air, which will flow in a direction toward an annular gap between the perimeter walls of the exhaust gas opening and the outer openings and into each of the heat exchange pipes or tubes. The inner chamber, whose outer walls and upper walls are heated by the burner, is, thus, surrounded by a mass of relatively cool air on essentially all sides so that the upper wall of the outer chamber is heated to a lower temperature than in the previous devices. Due to the special design of the exhaust gas openings of the inner chamber and the outer openings of the outer chamber, moreover, a Venturi-like nozzle is formed around every exhaust gas opening and air from the inner space between the outer chamber and the inner chamber is then suctioned or drawn through this nozzle by the flow of exhaust gases. In particular, the connection for the heat exchanger pipes is, thus, cooled, but the upper wall of the outer chamber is also cooled so that the temperature of only approximately 500° C. will now prevail.

The thermal stresses that normally occur in this region are thereby considerably reduced. In addition to the cooling effect, the air that is suctioned or drawn in effects an increase in the volume when mixed into the exhaust gases, so that the exhaust gas proceeds into the heat exchanger pipes, is greatly expanded in terms of volume. A satisfactory filling degree of the heat exchanger pipe and a good heat transfer into the environment is, thus, guaranteed. The exhaust gases continue to be throttled and are held longer in the inner chamber, due to the described volume effect. The heat generated by the burner can, thus, be considerably better exploited, since the exhaust gases are initially brought to a higher temperature that is then reduced to a lower temperature that is optimum for heat transfer, which reduction is due to the mixing of air from the inner space between the outer chamber and the inner chamber.

As a result of the high degree of filling, each of the heat exchanger pipes can be constructed with a comparatively large cross section. A large cross section of the heat exchanger pipe is beneficial in terms of design engineering and is possible because the inventive fashioning of the hot air exchanger also guarantees that such heat exchange pipes are adequately filled with exhuast gas in order to achieve a high heat transfer and, thus, a rapid heating of the ambient air that flows around each of the heat exchanger pipes.

Since the connecting region of the heat exchanger pipes is now thermally stressed to only a slight degree, it is also possible to forego the welded connection. On the contrary, it has proven advantageous to provide each of the heat exchanger pipes with a lower end section that proceeds in a tapered fashion and that has a shape adapted to the outer opening of the outer chamber and that is at least partially surrounded by a flange directed radially outward, which can be secured to the upper wall of the outer chamber. In an alternative embodiment, a separate, annular flange that surrounds the end section proceeding in a tapering fashion can be provided for each heat exchanger pipe, with the inside diameter of this annular flange being matched to the shape of the lower end section. The flanges are expediently connected to the upper wall of the outer space via screw connections. It has, thus, become possible to disassemble the individual components of the hot air heat exchanger in a simple manner.

A seal is advantageously provided between the outer chamber and each heat exchanger pipe. This can absorb a part of the mechanical stresses that still always occur due to thermal expansion, since the heat exchanger pipe remains relatively mobile vis-a-vis the upper wall of the outer chamber.

It is especially preferred when each heat exchanger pipe is arranged mobile in a sliding fashion in an axial direction and/or angularly mobile in the upper wall of the heat exchanger housing. Mechanical stresses that potentially occur at this location can, thus, also be compensated.

It is, therefore, preferred that the heat exchanger pipes are sealed to the sealing of the heat exchanger, for example by graphite seals.

Other advantages and features of the invention will be readily apparent from the following description of the preferred embodiments, the drawings and claims.

DESCRIPTION OF THE PREFERRED EMBODIMENTS

Figures 1, 2:
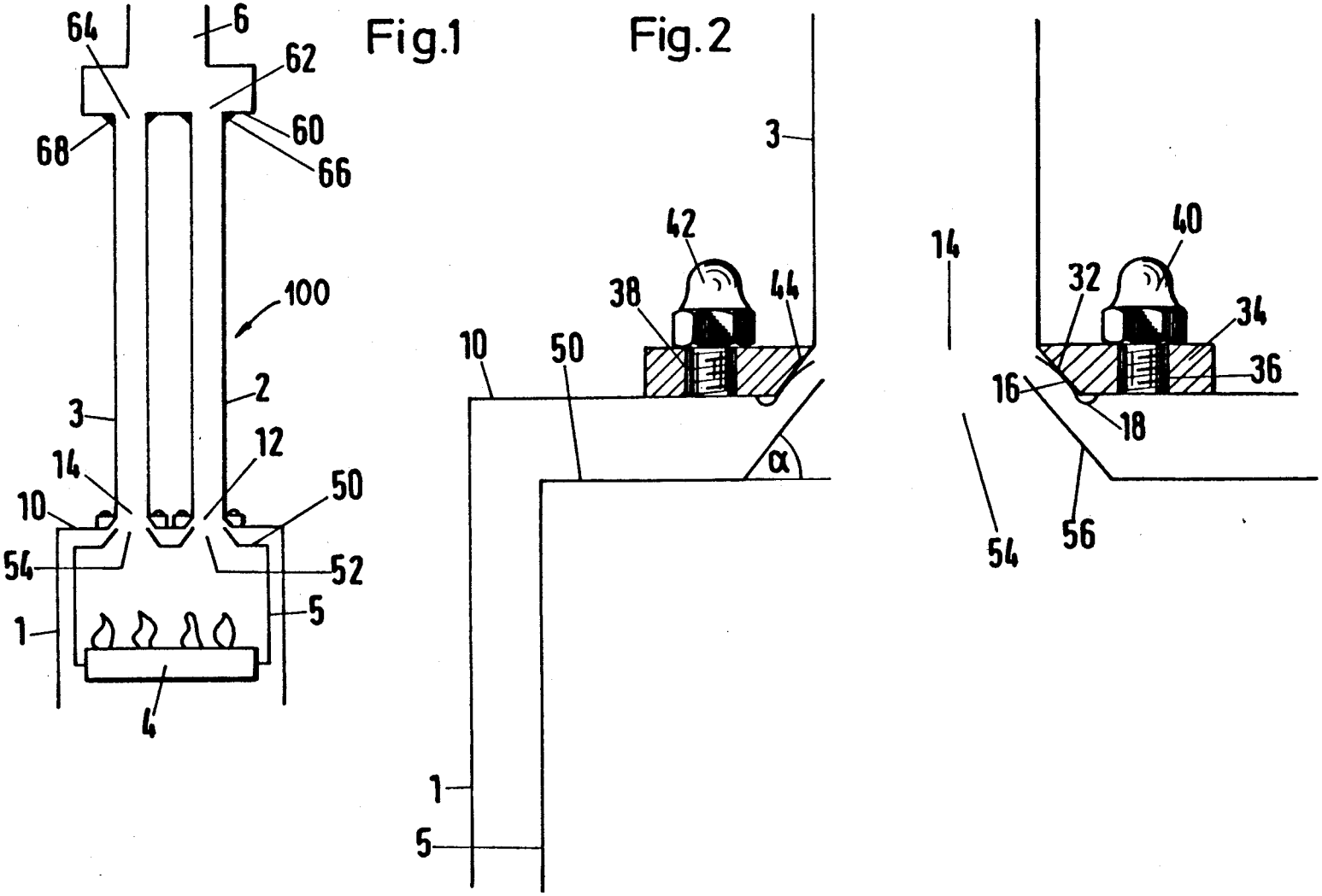
FIG. 1 is a schematic cross sectional view of a hot air heat exchanger of the present invention.
FIG. 2 is an enlarged detailed cross sectional view of the hot air heat exchanger of FIG. 1 at the transition region between the outer chamber and the heat exchanger pipe.

The principles of the present invention are particularly useful when incorporated in a hot air heat exchanger, generally indicated at 100 in FIG. 1. The hot air heat exchanger 100 has a floor 10, which is formed by an upper wall of an outer chamber 1. The heat exchanger also has a ceiling, upper wall or upper manifold 60 which has a connecting exhaust pipe 6. Two curved heat exchanger pipes or tubes 2 and 3 are conducted around a blower, which is not illustrated, and between the heat exchanger floor 10 and ceiling 60. The rest of the heat exchanger is not illustrated.

A gas burner 4 having a plurality of burner jets, that are directed vertically upward, is provided in the floor region of an inner chamber 5 that is arranged in the outer chamber 1 with an all-around spacing therebetween. The inner chamber 5, therefore, has relatively cool air that can freely flow into the space between the wall of the inner chamber 5 and the wall of the outer chamber 1. As illustrated in FIG. 1, the inner chamber 5 has an upper wall 50, which is provided with exhaust openings 52 and 54, which are aligned with the two tubes or pipes 2 and 3. Each of the exhaust openings 52 and 54 taper conically in the vertical direction and are aligned with outer openings 12 and 14 of the outer chamber 1, which opening also taper in the vertical direction, like with a spherical surface which is fashioned in the upper wall 10 of the outer chamber 1. These outer openings 12 and 14, however, are fashioned with less of a slope than the exhaust gas openings 52 and 54. The Venturi principle, however, can also be exploited when the slopes are fashioned equally or essentially equal.

The heat exchanger pipes or tubes 2 and 3 are put in place onto the openings 12 and 14 and are joined to the floor, which is formed by the upper wall 10 of the outer chamber 1 by a flange connection, as shall be described in greater detail with reference to FIG. 2.

Each of the heat exchanger pipes 2 and 3 has openings 62 and 64, which are provided in the ceiling or upper manifold 60 of the heat exchanger housing, whereby the connection is respectively terminated in essentially a gas-tight fashion by graphite seals 66 and 68, respectively. The graphite seals 66 and 68 make it possible for every heat exchanger tube or pipe 2 and 3 to move axially in a sliding fashion in its openings 62 and 64. Given a suitable diameter, an angular mobility is also established. The cool exhause gases are ultimately carried through the exhaust gas conduit 6.

As best illustrated in FIG. 2, an exhause gas opening 54 in the ceiling or upper wall 50 of the inner chamber 5 has a peripheral wall 56 that conically tapers in a vertical direction. For example, the peripehral wall 56 will have a slope angle $\alpha$ of approximately 56° relative to the plane of the upper wall 50. The outer chamber 1 is arranged around the inenr chamber 5 at a distance thereto. The upper wall 10 of the outer chamber 1 has an outer opening 14 with a surrounding peripheral wall 16 which tapers in the fashion of a concave spherical surface in the vertical direction and this opening 14 is aligned with the exhaust opening 54. The outer opening 14 is surrounded by an annular bead 18. In the region of these openings, the peripheral walls 56 and 16 of the two openings, namely the exhaust opening 54 and the outer opening 14 in the outer chamber, form a constriction that acts like a Venturi-like nozzle. Hot exhaust gas of the burner emerging through the exhaust opening 54 will entrain the relatively cool air from the space between the outer chamber 1 and the inner chamber 5 and this exhaust gas will have a high velocity, due to the constriction in the opening region. A relatively large, additional quantity of air is, thus, conducted into each of the heat exchanger pipes or tubes 3 and effects a high degree of filling therein. This is important for good heat transfer. The heat exchanger pipe or tube 3 itself has its lower end section 32 conically fashioned, whereby the slope is selected so that a contact surface shaped like a circular line and, thus, a seal vis-a-vis the perimeter wall 16 occurs. A flange 34, which surrounds the outer end section 32 and extends radially outward, is attached to the outer end section 32. At this flange 34, the heat exchanger pipe 3 is secured to the upper wall 10 of the outer chamber 1 with an adequate plurality of threaded bolts 40, 42 plus nuts (only two illustrated), and these bolts are conducted through bores, such as 36 and 38 of the flange 34.

Although various minor modifications may be suggested by those versed in the art, it should be understood that we wish to embody within the scope of the patent granted hereon all such modifications as reasonably and properly come within the scope of our contribution to the art.

We claim:

1. In a hot air heat exchanger comprising a heat exchanger housing having a floor which is essentially formed by an upper wall of an outer chamber containing a burner and having at least one heat exchanger pipe extending from the floor to an upper ceiling for conducting exhaust gases of the burner to heat ambient air flowing around the pipe, the improvements comprising the burner being disposed in an inner chamber, whose outer wall is arranged in the outer chamber with an all-around spacing therebetween, said inner chamber having an exhaust gas opening in an upper wall aligned with each heat exchanger pipe, said exhaust gas opening being provided with a perimeter wall that tapers in a direction toward the heat exchanger pipe and the outer chamber including an outer opening aligned with the exhaust gas opening of the inner chamber, each of said outer openings of said outer chamber being provided with a perimeter wall tapering in the direction toward the heat exchanger pipe with the heat exchanger pipe being secured in a gas-tight manner to the periphery wall of the outer opening, and said space between the inside wall surface of the outer chamber and the outside surface wall of the inner chamber being in communication with ambient air to allow flow of the air in an annular gap therebetween and between the perimeter walls of the exhaust gas opening and outer opening into the attached heat exchange pipe.

2. In a hot air heat exchanger according to claim 1, wherein the slope of the perimeter wall of each of the outer openings of the outer chamber is less than the slope of the perimeter wall of the respective exhaust gas opening.

3. In a hot air heat exchanger according to claim 2, wherein each heat exchanger pipe has an enlarged cross section.

4. In a hot air heat exchanger according to claim 1, wherein each heat exchanger pipe has a tapering lower end section provided with a radially outwardly directed flange, said outwardly directed flange at least partially surrounding said end section and being secured to the upper wall of the outer chamber.

5. In a hot air heat exchanger according to claim 1, wherein each of the heat exchanger pipes has a lower end section having an outwardly extending flange, one of said flanges of the heat exchanger pipe and the perimeter wall of the outer opening of the outer chamber having a spherical surface, and the other of said flange and peripheral wall having a conical surface to form an annular circular contact region between the end section and the perimeter wall.

6. In a hot air heat exchanger according to claim 1, which includes a seal being provided between the outer chamber and each of the heat exchanger pipes.

7. In a hot air heat exchanger according to claim 1, wherein each heat exchanger pipe is movable in a sliding fashion in the axial direction in the ceiling of the heat exchanger housing.

8. In a hot air heat exchanger according to claim 7, wherein each heat exchanger pipe is movable in an angular direction in the ceiling of the heat exchanger housing.

9. In a hot air heat exchanger according to claim 8, which includes a seal between each of the heat exchanger pipes and the ceiling of the heat exchanger housing.

10. In a hot air heat exchanger according to claim 9, wherein said seal is a graphite seal.

11. In a hot air heat exchanger according to claim 7, which includes a seal between each heat exchanger pipe and the ceiling of the heat exchanger housing.

12. In a hot air exchanger according to claim 11, wherein said seal is a graphite seal.

13. In a hot air heat exchanger according to claim 1, which has at least two heat exchange pipes.

* * * * *